US010233710B2

(12) United States Patent
Nguyen

(10) Patent No.: US 10,233,710 B2
(45) Date of Patent: Mar. 19, 2019

(54) ONE-TRIP HANGER RUNNING TOOL

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 112 days.

(21) Appl. No.: 15/384,133

(22) Filed: Dec. 19, 2016

(65) Prior Publication Data

US 2018/0171733 A1 Jun. 21, 2018

(51) Int. Cl.
*E21B 23/01* (2006.01)
*E21B 33/04* (2006.01)

(52) U.S. Cl.
CPC ..... *E21B 23/01* (2013.01); *E21B 33/04* (2013.01)

(58) Field of Classification Search
CPC ..... E21B 23/02; E21B 33/0415; E21B 23/01; E21B 33/04
See application file for complete search history.

(56) References Cited

U.S. PATENT DOCUMENTS

2011/0253389 A1* 10/2011 Nguyen ..... E21B 33/04 166/382
2015/0027738 A1* 1/2015 Nguyen ..... E21B 33/035 166/382
2016/0032674 A1* 2/2016 Nguyen ..... E21B 33/04 166/85.3
2016/0186523 A1* 6/2016 Nguyen ..... E21B 33/0415 166/382

FOREIGN PATENT DOCUMENTS

WO 2009-014795 A2 1/2009
WO 2011102877 A1 8/2011

OTHER PUBLICATIONS

PCT International Search Report and Written Opinion; PCT/US2017/066464; dated May 11, 2018; 11 pages.

* cited by examiner

*Primary Examiner* — Cathleen R Hutchins
(74) *Attorney, Agent, or Firm* — Fletcher Yoder, P.C.

(57) ABSTRACT

A system includes a hanger running tool that has a tool body configured to couple to a hanger via a first set of threads, a first sleeve coupled to configured to couple to the tool body via a second set of threads, where the first set of threads and the second set of threads are oriented in opposite directions, such that the first sleeve rotates in a first circumferential direction when the tool body rotates in a second circumferential direction, opposite the first circumferential direction, and a second sleeve coupled to the first sleeve, wherein the second sleeve is configured to engage a push ring of the hanger to drive a lock ring of the hanger into a recess of a casing spool.

20 Claims, 10 Drawing Sheets

ONE-TRIP HANGER RUNNING TOOL

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Oil and natural gas have a profound effect on modern economies and societies. In order to meet the demand for such natural resources, numerous companies invest significant amounts of time and money in searching for, accessing, and extracting oil, natural gas, and other subterranean resources. Particularly, once a desired resource is discovered below the surface of the earth, drilling and production systems are often employed to access and extract the resource. These systems can be located onshore or offshore depending on the location of a desired resource. Such systems generally include a wellhead assembly through which the resource is extracted. These wellhead assemblies may include a wide variety of components and/or conduits, such as blowout preventers (BOPs), as well as various control lines, casings, valves, and the like, that control drilling and/or extraction operations. Hangers (e.g., tubing hangers or casing hangers) may be used to support sections or strings of casing or tubing within a wellhead assembly. Hangers are typically installed by a tool (e.g., a hanger running tool) in multiple trips by the tool. Unfortunately, each trip by the tool increases the time and costs associated with installation of the hanger.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
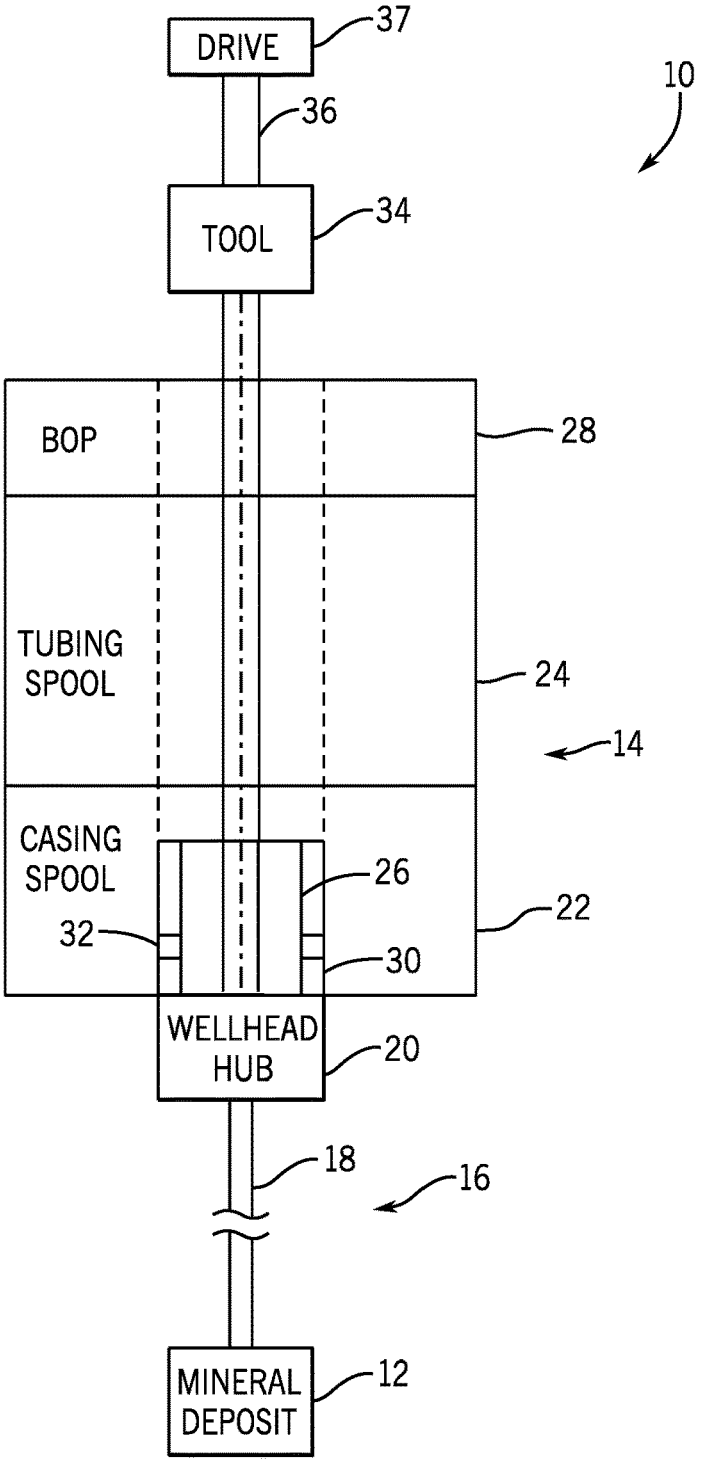
FIG. 1 is a schematic of an embodiment of a mineral extraction system that may utilize an enhanced hanger running tool, in accordance with an aspect of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

The presently disclosed embodiments include a mechanically actuated hanger running tool and hanger that is configured to install the hanger within a wellhead assembly in a single trip. Installing the hanger in a single trip reduces the time and cost associated with assembling and/or operating a mineral extraction system. Specifically, in the disclosed embodiments, the hanger running tool may be secured to the hanger on a rig platform. The running tool and hanger assembly may be directed into a wellbore, such that the hanger rests on a shoulder and/or lip of a wellhead component (e.g., a casing spool). To secure the hanger to the wellhead component (e.g., a casing spool), a first force (e.g., a first rotational force or a first circumferential force) may be applied to the hanger running tool to actuate a lock ring of the hanger, which may secure the hanger to the wellhead component. Subsequently, the hanger running tool may preload the lock ring upon application of a second force (e.g., a second rotational force or a second circumferential force) to the hanger running tool. Releasing the hanger running tool from the hanger (e.g., the running tool may be unthreaded from the hanger) may occur by again applying the first force while the lock ring between the hanger and the wellhead component remains in place. Accordingly, the running tool may be removed from the wellhead assembly and the hanger may be secured to the wellhead component. Additionally, in some embodiments, the running tool may be configured to retrieve the hanger from the wellhead in a single trip.

FIG. 1 is a schematic of a mineral extraction system 10 (e.g., hydrocarbon extraction system) configured to extract various natural resources, including hydrocarbons (e.g., oil and/or natural gas), from a mineral deposit 12. Depending upon where the natural resource is located, the mineral extraction system 10 may be land-based (e.g., a surface system) or subsea (e.g., a subsea system). The illustrated system 10 includes a wellhead assembly 14 coupled to the mineral deposit 12 or reservoir via a well 16. Specifically, a well bore 18 extends from the mineral deposit 12 (e.g., a reservoir) to a wellhead hub 20 located at or near the surface.

The illustrated wellhead hub 20, which may be a large diameter hub, acts as an early junction between the well 16 and the equipment located above the well 16. The wellhead hub 20 may include a complementary connector, such as a collet connector, to facilitate connections with the surface equipment. The wellhead hub 20 may be configured to support various strings of casing or tubing that extend into the wellbore 18, and in some cases extending down to the mineral deposit 12.

The wellhead 14 generally includes a series of devices and components that control and regulate activities and conditions associated with the well 16. For example, the wellhead 14 may provide for routing the flow of produced minerals from the mineral deposit 12 and the well bore 18, provide for regulating pressure in the well 16, and provide for the injection of chemicals into the well bore 18 (downhole). In the illustrated embodiment, the wellhead 14 includes a casing spool 22 (e.g., tubular), a tubing spool 24 (e.g., tubular), a hanger 26 (e.g., a tubing hanger or a casing hanger), and a blowout preventer (BOP) 28.

In operation, the wellhead 14 enables completion and workover procedures, such as tool insertion into the well 16 for installation and removal of various components (e.g., hangers, shoulders, etc.). Further, minerals extracted from the well 16 (e.g., oil and natural gas) may be regulated and routed via the wellhead 14. For example, the blowout preventer (BOP) 28 may include a variety of valves, fittings, and controls to prevent oil, gas, or other fluid from exiting the well 16 in the event of an unintentional release of pressure or an overpressure condition.

As illustrated, the casing spool 22 defines a bore 30 that enables fluid communication between the wellhead 14 and the well 16. Thus, the casing spool bore 30 may provide access to the well bore 18 for various completion and workover procedures, such as disposing tools or components within the casing spool 22. To dispose the components in the casing spool 22, a shoulder 32 provides a temporary or permanent landing surface that can support pieces of equipment (e.g., hangers). For example, the illustrated embodiment of the extraction system 10 includes a tool 34 suspended from a drill string 36. In certain embodiments, the tool 34 may include running tools (e.g., hanger running tools, shoulder running tools, slip tools, etc.) that are lowered (e.g., run) toward the well 16, the wellhead 14, and the like. Further, the tool 34 may be driven to move (e.g., axially or circumferentially) by a drive 37 that applies a torque or force to the tool 34 in order to install the hanger 26 in the casing spool 22, for example. The hanger 26 may be installed on the shoulder 32 and used to support sections of casing or tubing within the wellhead assembly 14. In some cases, it may be desirable to couple the hanger 26 to the casing spool 22 (e.g., to install tubing). However, typical hanger running tools and hangers may take multiple trips to couple the hanger 26 to the casing spool 22 and to remove the hanger running tool from the wellhead 14.

Figure 2:
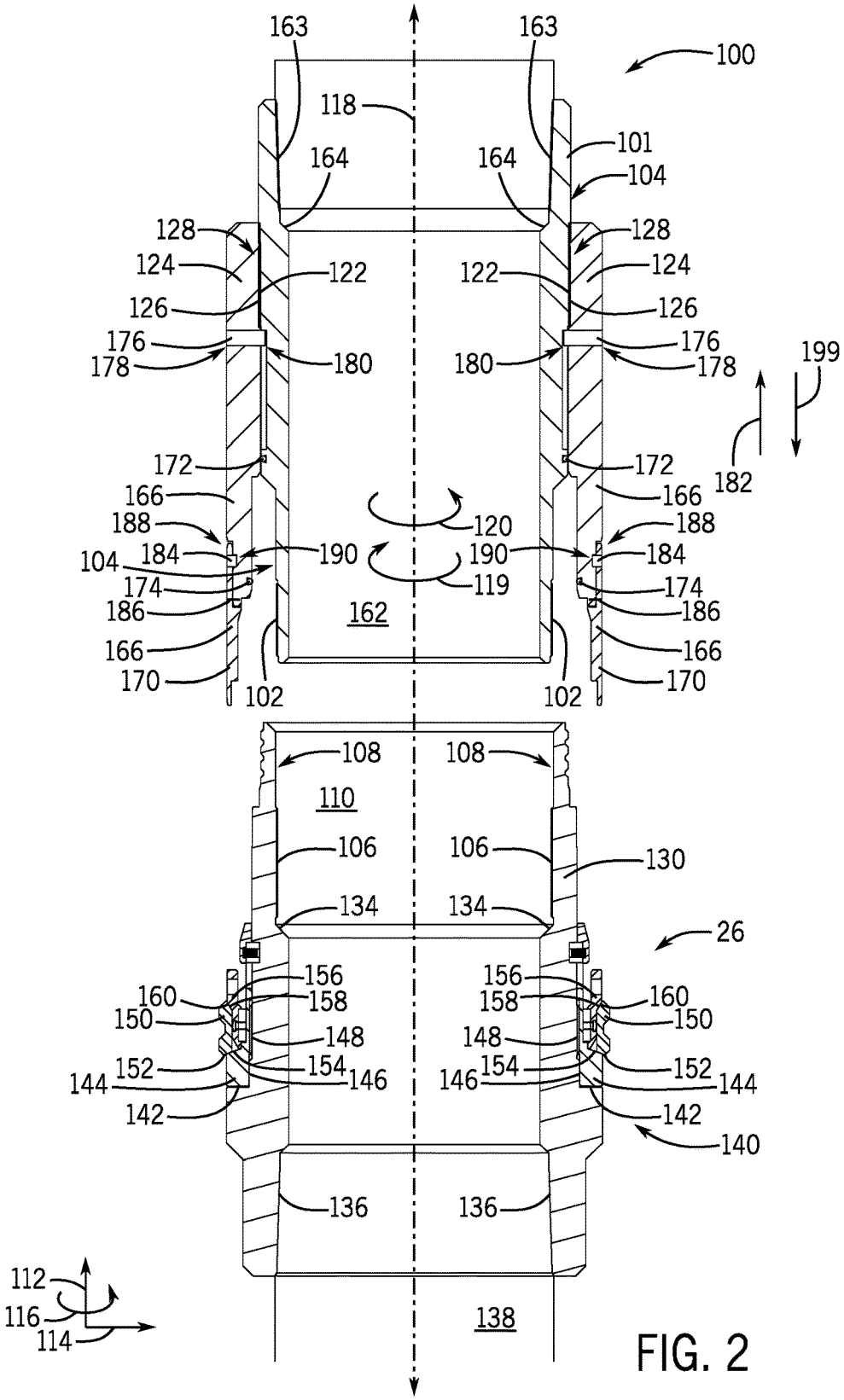
FIG. 2 is a side cross-section view of an embodiment of a hanger running tool and a hanger before the hanger running tool and the hanger are coupled to one another, in accordance with an aspect of the present disclosure.

Accordingly, embodiments of the present disclosure relate to an enhanced hanger running tool 100 and hanger 26 that may lock the hanger 26 to the casing spool 26, preload the hanger 26, and remove the hanger running tool 100 in a single trip. For example, FIG. 2 is a side, section view of the hanger running tool 100 being coupled to the hanger 26 for installation in the wellhead 14. In some embodiments, the hanger running tool 100 is coupled to the hanger 26 before the hanger running tool 100 is inserted into the wellhead assembly 14. For example, the hanger running tool 100 may be coupled to the hanger 26 on the rig floor. The hanger running tool 100 may include a body 101 (e.g., an annular body) that includes a first set of threads 102 (e.g., external or male threads, such as right hand threads) on an outer annular surface 104 and the hanger 26 may include corresponding threads 106 (e.g., internal or female threads) on an inner annular surface 108, such that the body 101 may be disposed in an annular opening 110 of the hanger 26 and secured to the hanger 26 via the threads 102 and 106. For reference, a coordinate system is shown comprising an axial direction or axis 112, a radial direction or axis 114, and a circumferential direction or axis 116 relative to a central axis 118 of the hanger running tool 100 and/or the hanger 26. In some embodiments, the hanger running tool 100 may be rotated in a first circumferential direction 119 about the central axis 118 to secure the hanger running tool 100 to the hanger 26 (e.g., to mesh the threads 102 and 106 to one another).

Additionally, the body 101 of the hanger running tool 100 may include a second set of threads 122 (e.g., external or male threads, such as left hand threads) on the outer annular surface 104 and a first sleeve 124 of the hanger running tool 100 may include corresponding threads 126 (e.g., internal or female threads) on an inner annular surface 128, such that the body 101 may be secured to the first sleeve 124 via the threads 122 and 126. It should be noted that the first set of threads 102 and the second set of threads 122 may be oriented in opposite directions. Accordingly, in some embodiments, the first set of threads 102 may be right hand threads (e.g., tightened when rotated in a counterclockwise direction) and the second set of threads 122 may be left hand threads (e.g., tightened when rotated in a clockwise direction). In other embodiments, the first set of threads 102 may be left hand threads and the second set of threads 122 may be right hand threads. In any case, rotation of the body 101 in the first circumferential direction 119 may drive rotation of the first sleeve 124 in the first circumferential direction 119. Similarly, rotation of the body 101 in a second circumferential direction 120 may drive rotation of the first sleeve 124 in the second circumferential direction 120.

As shown in the illustrated embodiment of FIG. 2, the hanger 26 includes a generally annular body 130, which defines the opening 110, an upper tapered annular shoulder 134 (e.g., conical shoulder), and a lower mounting interface 136 (e.g., internal threaded interface or female threads), which may be used to hang a tubular 138. Proximate an axial end 140 (e.g., downhole end) of the body 130 is a lip 142 (e.g., a radially protruding annular flange, shoulder, or axial abutment surface). Disposed about the body 130 is an annular preload ring 144. The preload ring 144 has an interior threaded surface 146 (e.g., left hand threads or threads oriented in a same direction as the second set of threads 122) that engages with an exterior threaded surface 148 (e.g., male threads) of the body 130 to secure the preload ring 144 in place relative to the body 130. Additionally, a lock ring 150 (e.g., an annular lock ring) may be disposed about the body 130 and the preload ring 144, and an inward tapered interior surface 152 (e.g., energizing taper portion) of the lock ring 150 may rest upon an inward tapered exterior surface or lip 154 (e.g., a radially protruding annular lip, tapered surface, or energizing taper portion) of the preload ring 144.

Additionally, a push ring 156 may be disposed about the body 130. The push ring 156 may have an inward tapered exterior surface 158 (e.g., energizing taper portion) that interfaces with an inward tapered interior surface 160 (e.g., energizing taper portion) of the lock ring 150. The surfaces 152, 154, 158, and 160 may be tapered annular surfaces (e.g., conical surfaces) that are acutely angled relative to the radial axis 114 and/or the axial axis 112. When the push ring 156 moves along the axis 112 toward the lock ring 150, the lock ring 150 may expand radially outward (e.g., toward a surface of the wellhead 14) as the tapered surface 158 of the push ring 156 engages the tapered surface 160 of the lock ring 150 and the tapered surface 154 of the preload ring 144 engages the tapered surface 152 of the lock ring 150. Correspondingly, when the push ring 156 moves along the axis 112 away from the lock ring 150, the lock ring 150 may radially contract (e.g., away from the surface of the wellhead 14). In some embodiments, angles of each of the tapered surfaces 152, 154, 158, and/or 160 may be substantially the same to create symmetry, thereby enabling an equally distributed force to be applied along a circumference of the lock ring 150. However, in other embodiments, the angles of each of the tapered surfaces 152, 154, 158, and/or 160 may be different from one another. The tapered surfaces 152, 154, 158, and/or 160 may include an angle between 45 and 150 degrees, between 50 and 140 degrees, and/or between 60 and 125 degrees relative to the axis 118. In other embodiments, the tapered surfaces 152, 154, 158, and/or 160 may include any suitable angle to facilitate movement of the lock ring 150 radially outward toward the casing spool 22.

The hanger running tool 100 includes the body 101 (e.g., an annular body), which defines a bore 162. In some embodiments, the body 101 includes a shoulder 164 (e.g., tapered annular shoulder or conical surface) facing in the axial downward direction 112, which may be configured to facilitate coupling of additional components to the annular body 101. Additionally or alternatively, the body 101 may include threads 163 (e.g., female threads) for coupling the body 101 to a string (e.g., a tubular string). Furthermore, the body 101 may be coupled to one or more push members 166 (e.g., linkages, rods, annular sleeves, or elongated structures), which may be used to actuate the push ring 156 and lock ring 150 of the hanger 26. In certain embodiments, the push members 166 include one or more sleeves disposed about the external surface 104 of the body 101. For example, the push members 166 may include the first sleeve 124 (e.g., a first annular sleeve and/or another suitable push member) that is disposed about the annular body 101 (e.g., coupled to the external surface 104 of the body 101). In some embodiments, a second sleeve 170 (e.g., a second annular sleeve and/or another suitable push member) may be coupled to the first sleeve 124 and/or to the body 101. The first sleeve 124 and/or the second sleeve 170 may be configured to contact one or more components of the hanger 26 and to apply an axial force on the push ring 156 and/or the lock ring 150 to couple the hanger 26 to the wellhead 14.

In some embodiments, a first seal 172 (e.g., an annular seal) may be disposed between the body 101 and the first sleeve 124 to form a seal between the body 101 and the first sleeve 124, such that a flow of fluid between the body 101 and the first sleeve 124 is substantially blocked. Additionally, a second seal 174 (e.g., an annular seal) may be disposed between the first sleeve 124 and the hanger 26 (e.g., when the hanger 26 is disposed in the opening 110) to form a seal between the first sleeve 124 and the hanger 26, such that a flow of fluid between the first sleeve 124 and the hanger 26 is substantially blocked.

As discussed above, the first sleeve 124 may be coupled to the body 101 by the second set of threads 122 (e.g., left hand threads) on the outer annular surface 104 of the body 101 and the corresponding threads 126 on the inner annular surface 128 of the first sleeve 124. In some embodiments, the first sleeve 124 may also be coupled to the body 101 of the hanger running tool 100 via one or more pins 176 (e.g., one, two, three, four, five, six, seven, eight, nine, ten, or more pins 176). The one or more pins 176 may be disposed in an opening or a slot 178 of the first sleeve 124 and extend into a groove 180 (e.g., annular groove) of the body 101. Accordingly, when removal of the hanger running tool 100 from the wellhead 14 is desired, movement of the body 101 in a first axial direction 182 along the axial axis 112 may also cause movement of the first sleeve 124 in the first axial direction 182 because of the one or more pins 176.

Additionally, the second sleeve 170 may be coupled to the first sleeve 124 via one or more second coupling pins 184 (e.g., one, two, three, four, five, six, seven, eight, nine, ten, or more pins 184). The one or more second coupling pins 184 may be uniformly spaced circumferentially about the first sleeve 124 and the second sleeve 170. In other embodiments, the one or more second coupling pins 184 may not be uniformly spaced. In addition, one or more shear pins 186 (e.g., one, two, three, four, five, six, seven, eight, nine, ten, or more shear pins 186) may also extend into both the first sleeve 124 and the second sleeve 170, such that rotation of the first sleeve 124 drives rotation of the second sleeve 170 until the one or more shear pins 186 shear (e.g., break). The one or more shear pins 186 may be uniformly spaced circumferentially along the first sleeve 124 and the second sleeve 170, or in other embodiments, the one or more shear pins 186 may not be uniformly spaced about the first sleeve 124 and the second sleeve 170.

In any case, when the one or more shear pins 186 shear, rotation of the first sleeve 124 may not drive rotation of the second sleeve 170 (e.g., rotation of the first sleeve 124 is independent of the second sleeve 170). Regardless of whether the one or more shear pins 186 are intact or sheared, movement of the first sleeve 124 along the axial axis 112 may drive movement of the second sleeve 170 along the axial axis 112 as a result of the one or more second coupling pins 184. The one or more second coupling pins 184 may each extend through an opening or slot 188 of the second sleeve 170 and into a groove 190 (e.g., annular groove) of the first sleeve 124. Accordingly, while in some cases the first sleeve 124 may rotate independent of the second sleeve 170 (e.g., the one or more second coupling pins 184 move circumferentially along the groove 190), movement of the first sleeve 124 along the axial axis 112 drives movement of the second sleeve 170 along the axial axis 112, and vice versa.

As discussed above, the hanger running tool 100 may be coupled to the hanger 26 on a rig platform or surface by disposing the hanger running tool 100 into the annular opening 110 of the hanger 26. The hanger running tool 100 may rotate in the first circumferential direction 119 with respect to the hanger 26 to mesh the threads 102 and 106 with one another and secure the hanger running tool 100 to the hanger 26. In some embodiments, the hanger running tool 100 and/or the hanger 26 may include a stop and/or another indicator, such that the hanger running tool 100 and the hanger 26 may be sufficiently coupled to one another (e.g., threaded) before being disposed the hanger running tool 100 and the hanger 26 into the well 16, but without driving the lock ring 150. When the hanger running tool 100 rotates in the first circumferential direction 119 in the well 16, the body 101 may rotate in the first circumferential direction 119 independent of the hanger 26 (e.g., the hanger is stationary on a shoulder 192 of the well 16). However, as discussed above, the rotation of the body 101 in the first circumferential direction 119 may drive rotation of the first sleeve 124 in the first circumferential direction 119.

Figure 3:
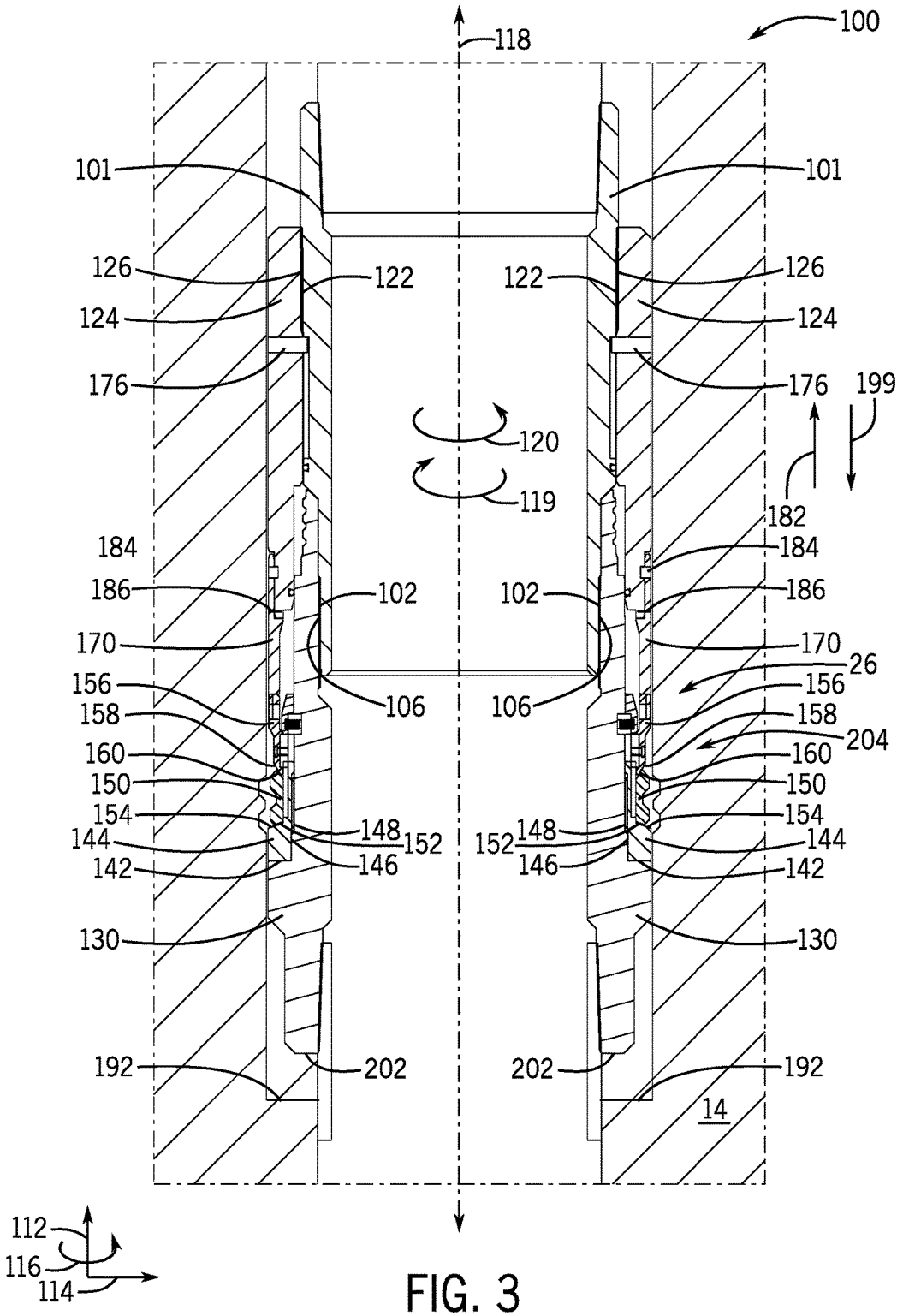
FIG. 3 is a side cross-section view of an embodiment of the hanger running tool and the hanger of FIG. 2 coupled to one another and a lock ring of the hanger in an unlocked position, in accordance with an aspect of the present disclosure.

FIG. 3 is a side, section view of the hanger running tool 100 disposed over and about the hanger 26, such that the body 101 of the hanger running tool 100 is disposed circumferentially about the body 130 of the hanger 26. As discussed above, the threads 102 and 106 may secure the hanger running tool 100 to the hanger 26. Additionally, FIG. 3 shows the hanger running tool 100 and hanger 26 inserted into a wellhead assembly 14. As shown, the hanger running tool 100 and hanger 26 are inserted into the wellhead assembly 14 by running the hanger running tool 100 coupled to the hanger 26 in a second axial direction 199 along the axial axis 112 until a lip 202 of the hanger 26 lands on the corresponding shoulder 192 (e.g., tapered annular landing shoulder) of the casing spool 22.

Figure 4:
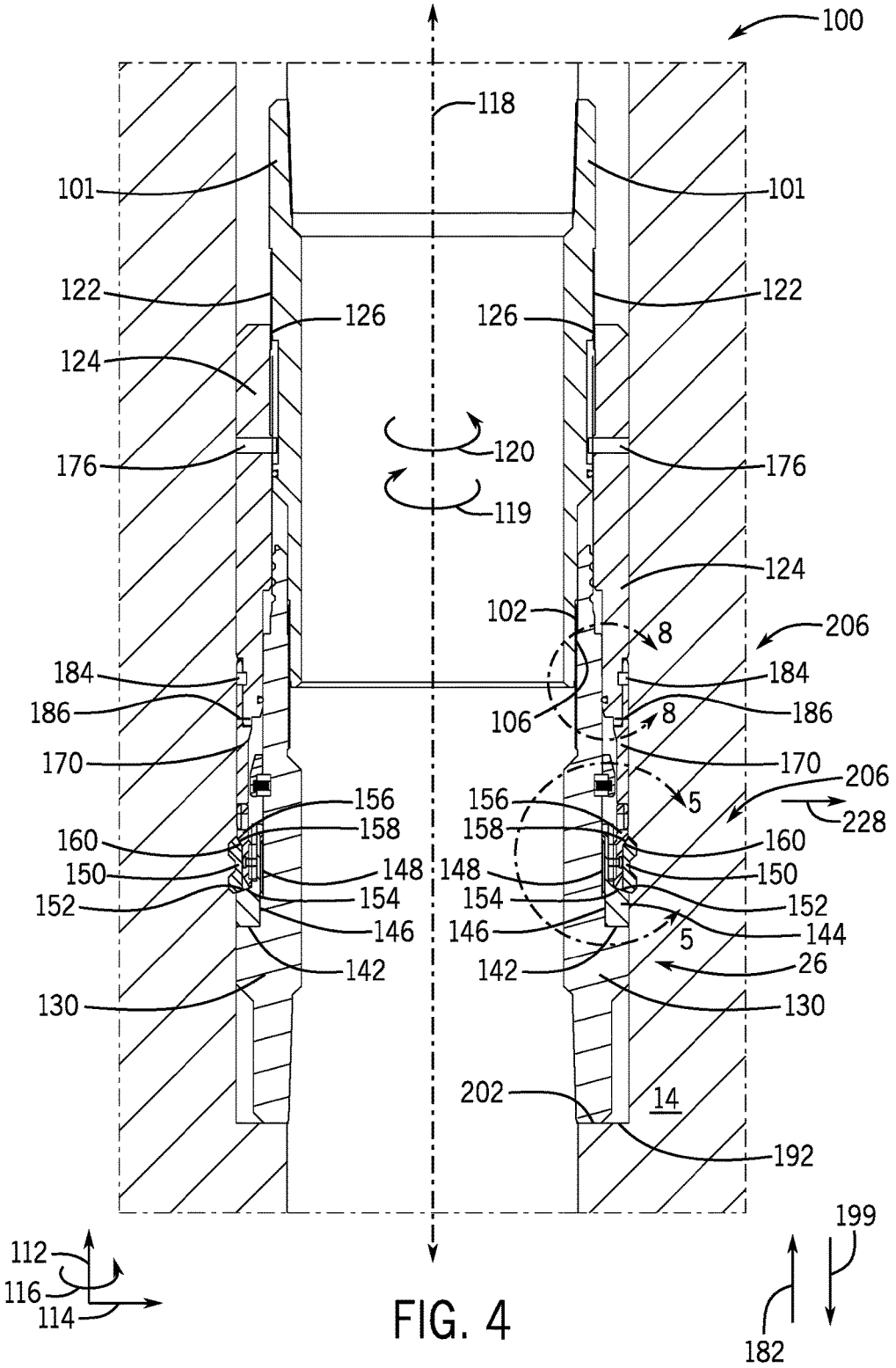
FIG. 4 is a side cross-section view of an embodiment of the lock ring of the hanger of FIG. 3 in a locked position, in accordance with an aspect of the present disclosure.

When the lip 202 of the hanger 26 lands on the shoulder 192, the hanger 26 may be installed by actuating the lock ring 150. FIG. 3 is a side, section view illustrating an unlocked position 204 of the lock ring 150, whereas FIG. 4 is a side, section view illustrating a locked position 206 of the lock ring 150. To move the lock ring 150 from the unlocked position 204 (e.g., a default position) to the locked position 206, the hanger running tool 100 may be rotated in the second circumferential direction 120. Rotation of the hanger running tool 100 in the second circumferential direction 120 may drive rotation of the body 101 of the hanger running tool 100 in the second circumferential direction 120. Accordingly, the threads 102 of the hanger running tool 100 may begin to disengage with the threads 106 of the hanger 26, thereby driving the hanger running tool 100 in the first axial direction 182 (e.g., vertical upward direction) along the axis 112.

Additionally, rotation of the body 101 in the second circumferential direction 120 may drive rotation of the first sleeve 124 in the second circumferential direction 120. However, because of the opposite orientation of the threads 102 and 122, rotation of the first sleeve 124 in the second circumferential direction 120 causes the first sleeve 124 to move in the second axial direction 199. Thus, as the hanger running tool 100 is rotated in the second circumferential direction 120, the body 101 and the first sleeve 124 move in opposite axial directions.

To lock the lock ring 150 into the casing spool 22, rotation of the hanger running tool 100 in the second circumferential direction 120 may drive the first sleeve 124 to move in the second axial direction 199, which may in turn, direct the second sleeve 170 to move in the second axial direction 199. Movement of the second sleeve 170 in the second axial direction 199 may enable the second sleeve 170 to engage the push ring 156 of the hanger 26. For example, in some embodiments, the second sleeve 170 may have circumferentially spaced slots and/or teeth that are configured to engage corresponding circumferentially spaced slots and/or teeth of the push ring 156 (e.g., see FIG. 7).

Movement of the second sleeve 170 in the second axial direction 199 may then drive movement of the push ring 156 in the second axial direction 199 toward the lock ring 150. As shown in the illustrated embodiment of FIG. 4, the lock ring 150 may include the tapered surface 160 (e.g., an upper or first tapered annular surface) and the tapered surface 152 (e.g., a lower or second tapered annular surface). The first tapered surface 160 may be positioned above the second tapered surface 152 with respect to the axial axis 112. The tapered surface 158 (e.g., tapered annular surface) of the push ring 156 may contact the first tapered surface 160 of the lock ring 150, thereby initially directing the lock ring 150 in the second axial direction 199 along the axis 112. However, the second tapered surface 152 may contact the tapered surface 154 (e.g., tapered annular surface) of the preload ring 144 as the lock ring 150 moves in the second axial direction 199. Accordingly, the force applied by the push ring 156 may cause the lock ring 150 to move radially outward in the radial direction 114, as shown by arrow 228. For example, forces may be applied to both tapered surfaces 160 and 152 of the lock ring 150 by the tapered surfaces 154 and 158 of the preload ring 144 and the push ring 156, respectively. The forces applied to the lock ring 150 may bias the lock ring 150 radially outward because of the angles of the tapered surfaces 152, 154, 158, and/or 160. As discussed above, in some embodiments, the angles of each of the tapered surfaces 152, 154, 158, and/or 160 may be substantially equal, such that the forces applied to the lock ring 150 are symmetric, thereby uniformly biasing the lock ring 150 radially outward. When the lock ring 150 moves radially outward, the lock ring 150 may be received in a corresponding recess (e.g., an annular recess) of the casing spool 22. When the lock ring 150 is disposed in the annular recess of the casing spool 22, relative axial movement between the casing spool 22 and the hanger 26 is restricted.

Figure 5:
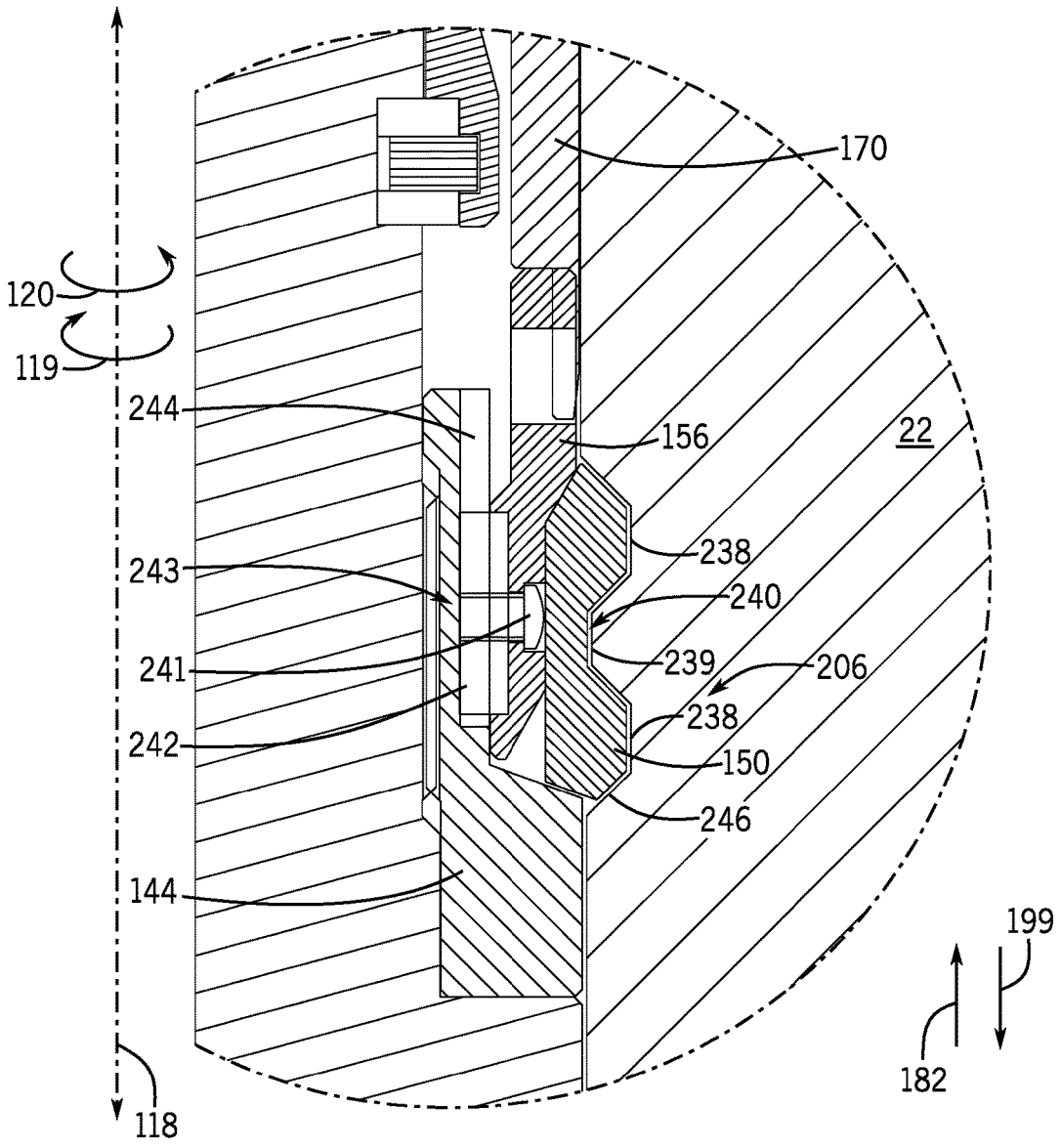
FIG. 5 is a partial, side cross-section view of an embodiment of the lock ring of FIG. 4 in the locked position taken within line 5-5 of FIG. 4, in accordance with an aspect of the present disclosure.

For example, FIG. 5 is a partial, cross-section view of the lock ring 150 disposed in a recess 240 (e.g., annular recess) of the casing spool 22. The recess 240 may include an annular protrusion 238 and annular grooves 239 that may substantially conform to an annular shape of the lock ring 150. The annular protrusion 238 and the annular grooves 239 may block movement of the lock ring 150 when the lock ring 150 is disposed in the recess 240 (e.g., friction between the surfaces of the lock ring 150 and the recess 240 may substantially maintain the lock ring 150 within the recess 240). As shown in the illustrated embodiment of FIG. 5, the push ring 156 may be coupled to one or more keys 242 (e.g., axial guide keys) configured to slide in one or more grooves 244 (e.g., axial guide grooves) of the preload ring 144 as the push ring 156 moves in the second axial direction 199. The push ring 156 may be coupled to the one or more keys 242 by one or more fasteners 241 disposed in a bore 243 (e.g., radial bore) extending through the push ring 156 and into the one or more keys 242. The push ring 156 may be configured to be disposed between the preload ring 144 and the lock ring 150 as the push ring 156 moves in the second axial direction 199 (e.g., thereby directing the lock ring 150 radially outward). In some embodiments, the push ring 156 may at least partially conform to the lock ring 150, such that the push ring 156 holds the lock ring 150 in the recess 240 of the casing spool 22.

When the lock ring 150 contacts a surface 246 of the recess 240, the hanger running tool 100 may not rotate in the second circumferential direction 120 because of resistance created by contact between the lock ring 150 and the surface 246 of the recess 240 (e.g., the resistance may block further movement of the first sleeve 124 and/or the second sleeve 170 in the second axial direction 199). In other words, the lock ring 150 may be blocked from moving radially outward and/or in the second axial direction 199 by the recess 240. Therefore, the hanger running tool 100 may not drive the first sleeve 124 and/or the second sleeve 170 further downward in the second axial direction 199. As a result, resistance may be sensed in the hanger running tool 100 via one or more sensors (e.g., piezoelectric sensors, force sensors, torque sensors, or another suitable sensor). In some embodiments, an operator of the hanger running tool 100 may be alerted that the lock ring 150 is in the locked position 206 when the hanger running tool 100 resists rotation in the first circumferential direction 120 and/or when the one or more sensors indicate that the hanger running tool 100 resists rotation. When the lock ring 150 is in the locked position 206, the hanger running tool 100 may be rotated in the first circumferential direction 119 to preload the lock ring 150 in the recess 240.

Figure 6:
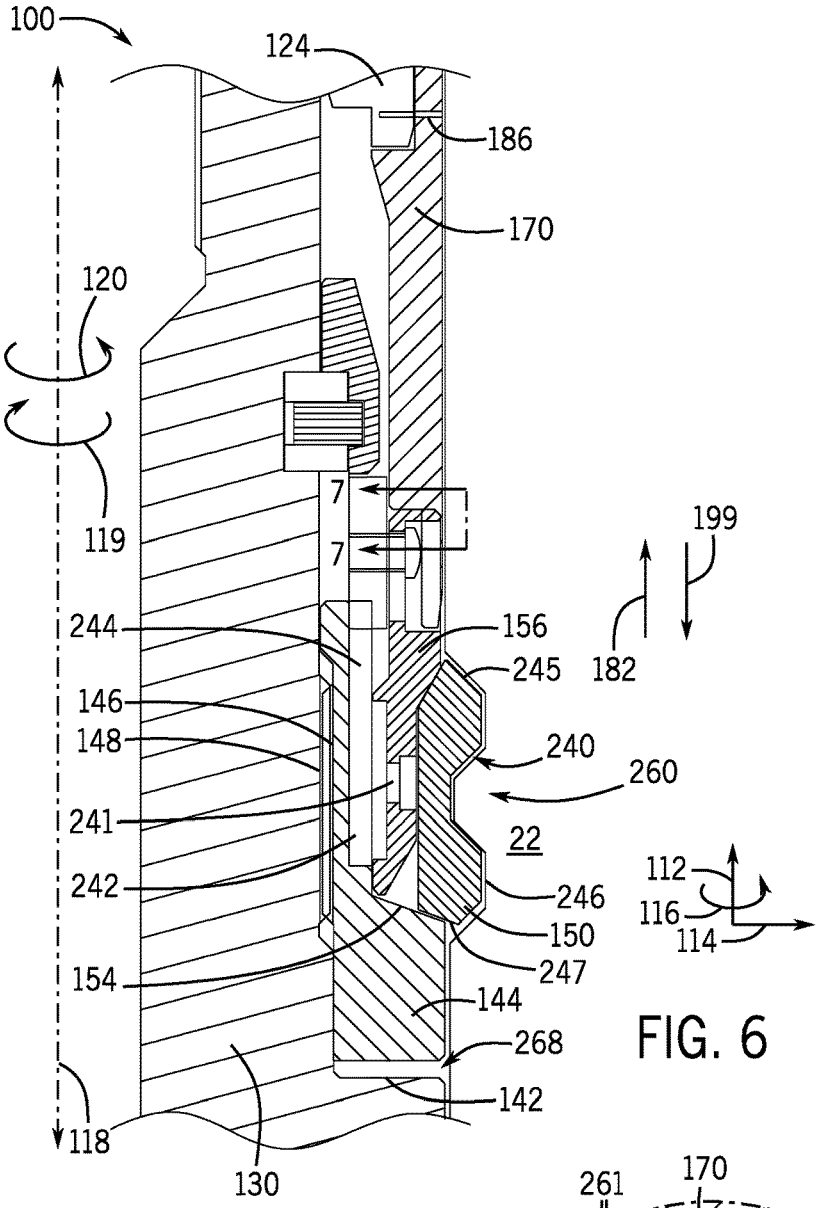
FIG. 6 is a partial, side cross-section view of an embodiment of a second sleeve of the hanger running tool coupled to a push ring of the hanger taken within line 5-5 of FIG. 4, in accordance with an aspect of the present disclosure.
Figure 7:
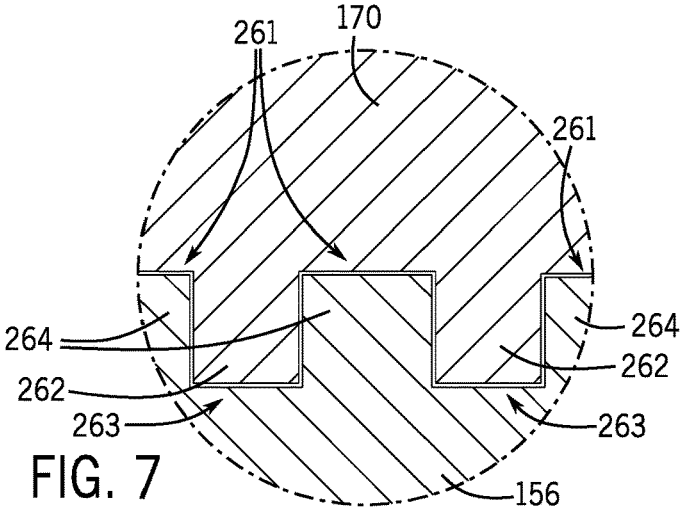
FIG. 7 is a cross-section of an embodiment of an interface between the second sleeve and the push ring of FIG. 6 taken along line 7-7 of FIG. 6, in accordance with an aspect of the present disclosure.

For example, FIG. 6 is a partial, cross-section view of the lock ring 150 when in a preloaded position 260. When the hanger running tool 100 rotates in the first circumferential direction 119, the first sleeve 124 and the second sleeve 170 may rotate in the first circumferential direction 119. Rotation of the second sleeve 170 in the first circumferential direction 119 may be driven by the first sleeve 124, because of the one or more shear pins (see, e.g., FIG. 4) that couple the first sleeve 124 and the second sleeve 170 to one another. In turn, as shown in FIG. 7, rotation of the second sleeve 170 drives rotation of the push ring 156 because circumferentially spaced slots 261 and teeth 262 of the second sleeve 170 mesh with circumferentially spaces slots 263 and teeth 264 of the push ring 156. Accordingly, the push ring 156 rotates in the first circumferential direction 119 as the second sleeve 170 rotates in the first circumferential direction 119. Additionally, the one or more keys 242 may also rotate in the first circumferential direction 119 as a result of being coupled to the push ring 156 via the one or more fasteners 241. Further, because each key 242 (e.g., axial guide key) is disposed in a corresponding groove 244 (e.g., axial guide groove) of the preload ring 144, rotation of the key 242 in the first circumferential direction 119 drives rotation of the preload ring 144 in the first circumferential direction 119. In other words, the engagement of the one or more keys 242 and the one or more grooves 244 enables torque transfer between the push ring 156 and the preload ring 144.

As shown in the illustrated embodiment of FIG. 6, rotation of the preload ring 144 in the first circumferential direction 119 may partially unthread the preload ring 144 (e.g., the threaded interior surface 146) from the hanger body 130 (e.g., the threaded exterior surface 148), thereby causing the preload ring 144 to move in the in the first axial direction 182. Thus, a gap 268 (e.g., an axial gap) may form between the preload ring 144 and the lip 142 of the hanger body 130. Additionally, movement of the preload ring 144 in the first axial direction 182 may drive movement of the key 242, the push ring 156, and/or the lock ring 150 in the first axial direction 182. Accordingly, a first lock surface 245 (e.g., tapered annular lock surface) of the lock ring 150 contacts the surface 246 (e.g., axially upper or top tapered annular surface) of the recess 240, while a second lock surface 247 (e.g., tapered annular lock surface) of the lock ring 150 contacts the lip 154 of the preload ring 144. In this manner, the lock ring 150 is axially squeezed or compressed between the surface 246 of the recess 240 and the lip 154 of the preload ring 144, thereby providing positive contact on the top and bottom surfaces 245 and 247 of the lock ring 150. Upon contacting the surface 246, the lock ring 150 cannot be driven any further in the first axial direction 182, thereby blocking rotation of the preload ring 144, the key 242, the push ring 156, and/or the second sleeve 170. Accordingly, the lock ring 150 may be in the preload position 260. The second sleeve 170 may resist rotation in the first circumferential direction 119 when the lock ring 150 reaches the preload position 260, which may then cause the one or more shear pins 184 to shear.

Figure 8:
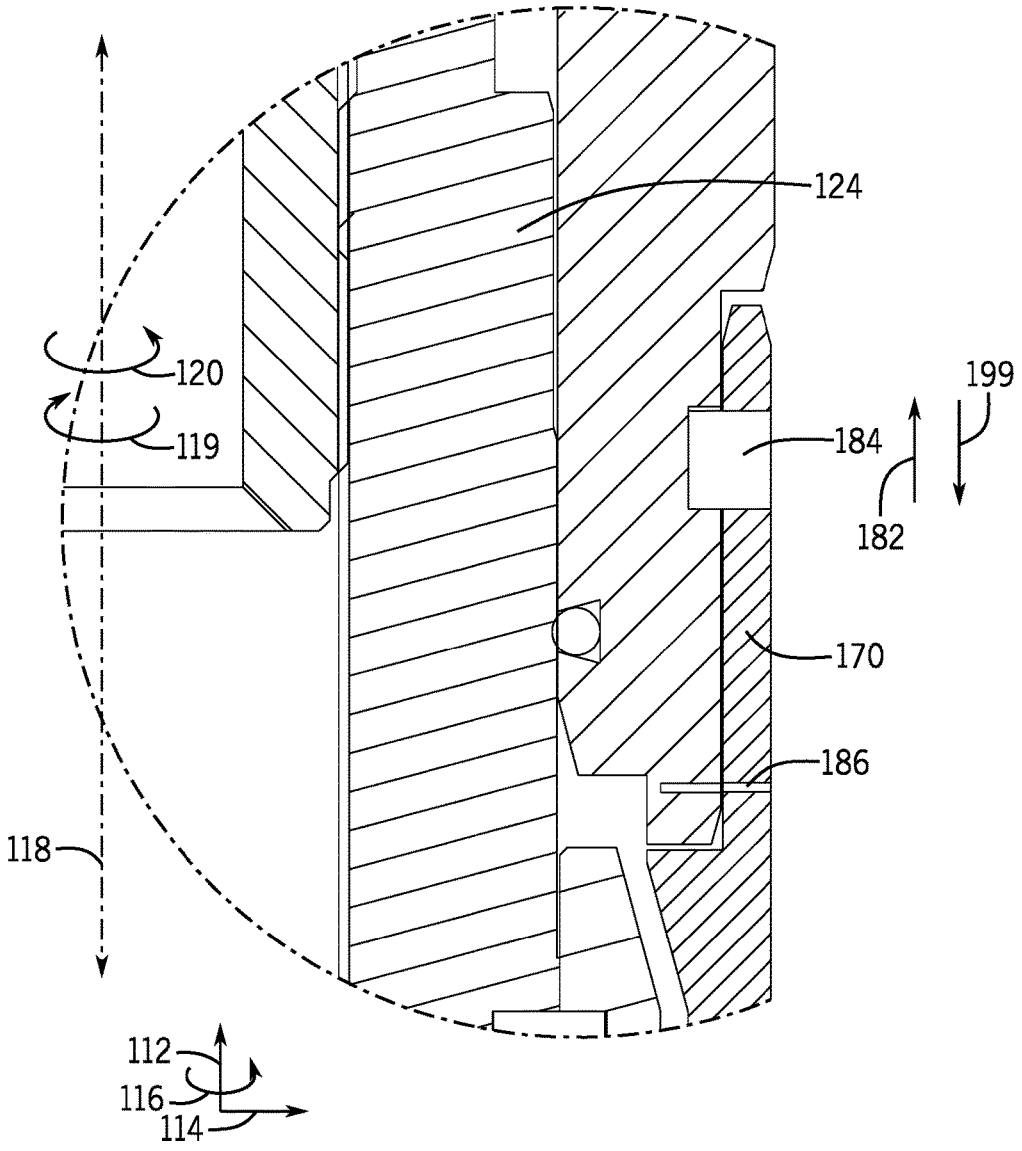
FIG. 8 is a partial, side cross-section view of an embodiment of a shearing pin coupling the second sleeve of the hanger running tool to a first sleeve of the hanger running tool taken along line 8-8 of FIG. 4, in accordance with an aspect of the present disclosure.

For example, FIG. 8 is a partial, cross-section view of one of the shear pins 184 coupling the first sleeve 124 and the second sleeve 170. When the lock ring 150 reaches the preload position 260, the second sleeve 170 may be blocked from rotating in the first circumferential direction 119 as a result of the teeth 262 of the second sleeve 170 engaged with the teeth 264 of the push ring 156. Therefore, the one or more shear pins 184 may shear, which may enable the first sleeve 124 to continue rotating in the first circumferential direction 119. In some embodiments, the hanger running tool 100 may include a sensor and/or other monitoring device configured to determine when the shear pins 184 shear (e.g., piezoelectric sensors, force sensors, torque sensors, or another suitable sensor). When the hanger running tool 100 and/or an operator of the hanger running tool 100 detects that the shear pins 184 have sheared, the hanger running tool 100 may again be rotated in the second circumferential direction 120, thereby causing the body 101 to rotate in the second circumferential direction 120.

As the body 101 rotates in the second circumferential direction 120, the threads 102 of the hanger running tool 100 (e.g., on the body 101 of the hanger running tool 100) may uncouple from the threads 106 of the hanger 26, thereby decoupling the hanger running tool 100 from the hanger 26. When the threads 102 of the hanger running tool 100 are uncoupled from the threads 106 of the hanger 26, the hanger running tool 100 (e.g., the body 101, the first sleeve 124, and the second sleeve 170) may be directed in the first axial direction 182 toward the rig platform and removed from the well 16.

Figure 9:
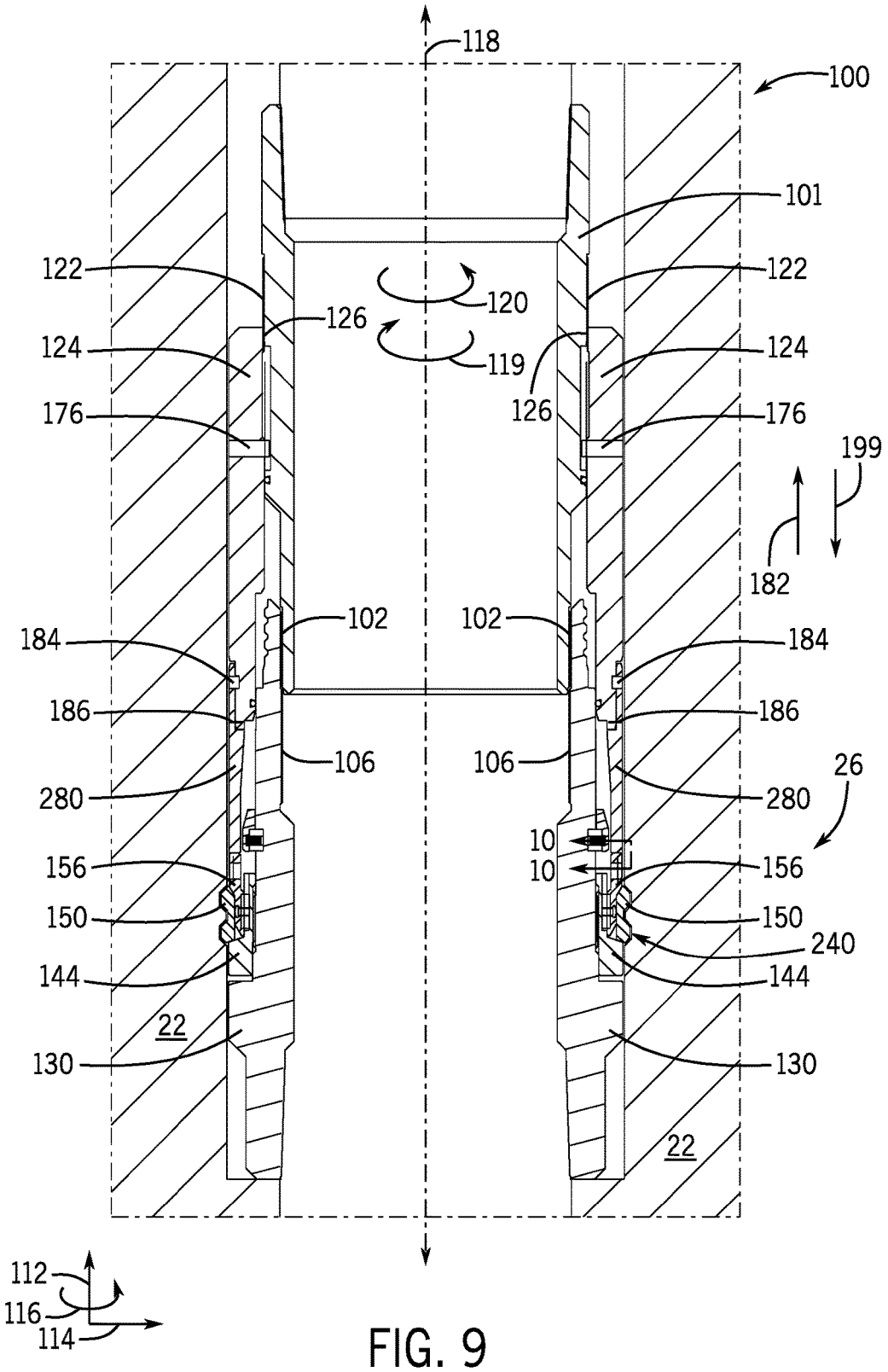
FIG. 9 is a side cross-section view of an embodiment of the hanger running tool configured to retrieve the hanger from a casing spool, in accordance with an aspect of the present disclosure.
Figure 10:
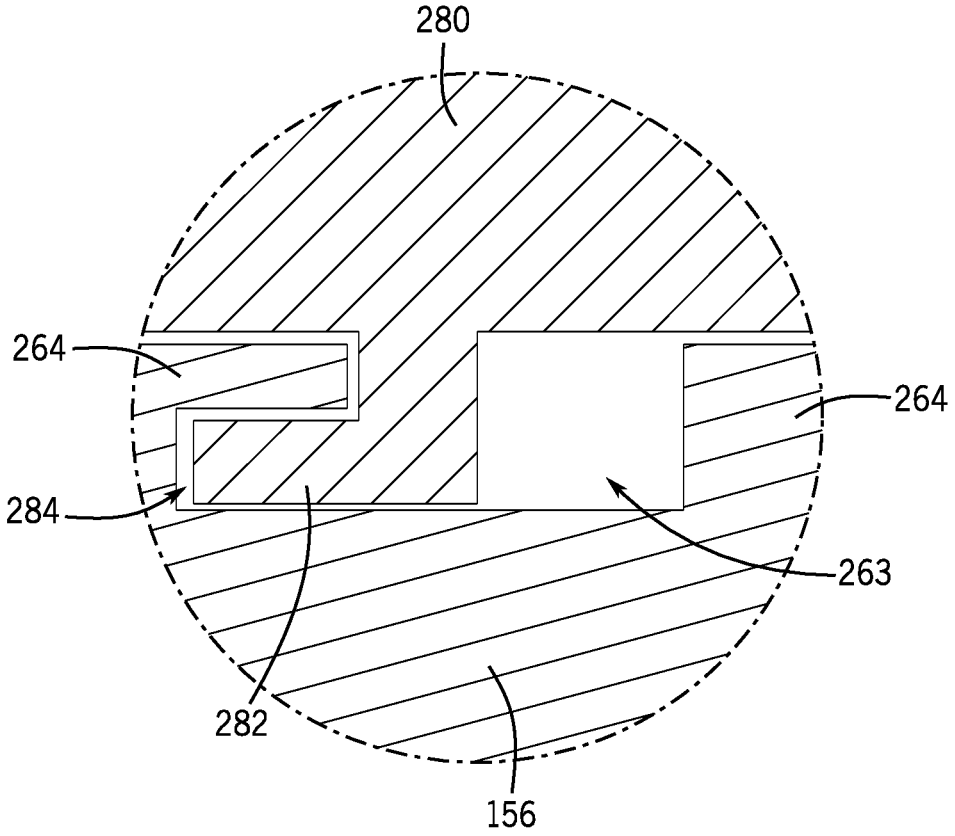
FIG. 10 is a partial, cross-section view of an embodiment of an interface between a second sleeve of the hanger running tool of FIG. 9 and the push ring of the hanger taken along line 10-10 of FIG. 9, in accordance with an aspect of the present disclosure.

While the embodiments discussed above focus on the hanger running tool 100 being configured to run, lock, and preload the hanger 26, other embodiments of the hanger running tool 100 may be configured to remove the hanger 26 from the well 16. For example, FIG. 9 is a side section view of an embodiment of the hanger running tool 100 that may be utilized to remove the hanger 26 from the well. As shown in the illustrated embodiment of FIG. 9, the hanger running tool 100 may include a second sleeve 280 that may be configured to engage the push ring 156 of the hanger 26. For example, FIG. 10 is an expanded section view of the second sleeve 280 having one or more engaging members 282 (e.g., an "L" shaped member) configured to engage with corresponding grooves 284 in the teeth 264 of the push ring 156.

In some embodiments, the hanger running tool 100 may be rotated in the first circumferential direction 119, thereby driving the first sleeve 124, and thus the second sleeve 280, in the first circumferential direction 119. As the first sleeve 124 and the second sleeve 280 rotate in the first circumferential direction 119, both the first sleeve 124 and the second sleeve 280 may be directed in the second axial direction 199. Thus, the second sleeve 280 may engage the push ring 156 (e.g., the engaging member 282 may be directed into the slots 263 between the teeth 264 of the push ring 156). The hanger running tool 100 may then be rotated in the second circumferential direction 120, such that the first sleeve 124 and the second sleeve 280 are driven to rotate in the second circumferential direction 120. As the first sleeve 124 and the second sleeve 280 rotate in the second circumferential direction 120, the engaging member 282 may be directed into the groove 284 of the teeth 264, such that movement of the second sleeve 280 in the first axial direction 182 drives movement of the push ring 156 in the first axial direction 182 (e.g., via a force applied by the engaging member 282 to the groove 284 and the push ring 156).

As the push ring 156 moves in the first axial direction 182, the lock ring 150 may be directed in the radial direction 114 (e.g., due to a bias of the lock ring 150) toward the preload ring 144, thereby disengaging the lock ring 150 from the recess 240 of the casing spool 22 and enabling movement of the hanger 26 along the axial axis 112. Accordingly, in some embodiments, the hanger running tool 100 may simply be directed in the first axial direction 182 to remove the hanger 26 from the well 16 (e.g., when the hanger running tool 100 rotates in the first circumferential direction 119, the threads 102 of the body 101 of the hanger running tool 100 further engage the threads 106 of the hanger 26 for a secure connection).

Figure 11:
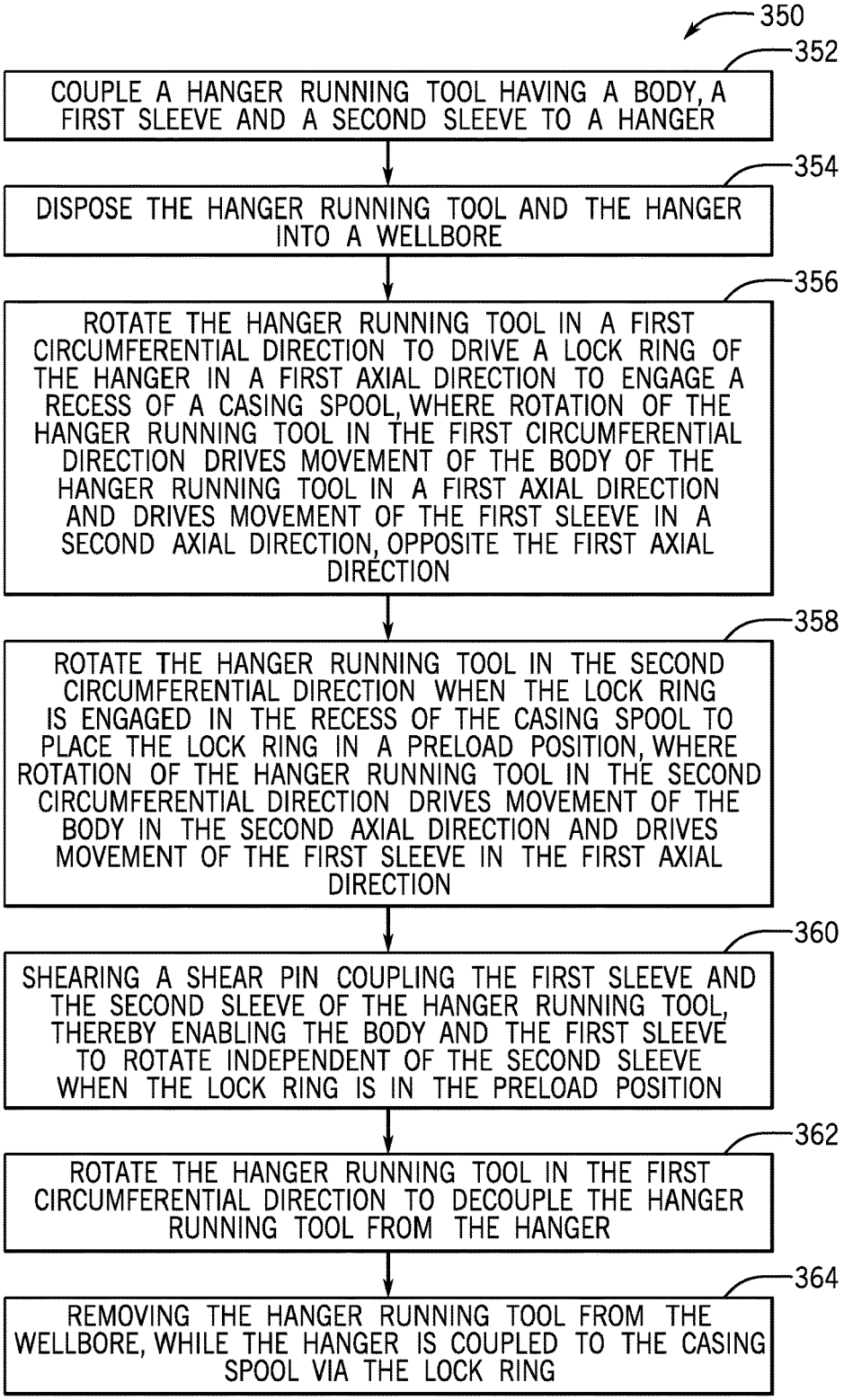
FIG. 11 is a flow chart of an embodiment of a process that may be used to couple the hanger of FIG. 2 to the casing spool, in accordance with an aspect of the present disclosure.

FIG. 11 is a block diagram of a process 350 that may be utilized to lock the lock ring 150 in the casing spool 22, preload the lock ring 150 in the casing spool 22, and remove the hanger running tool 100 from the hanger 26 in a single trip. For example, at block 352, the hanger running tool 100 may be coupled to the hanger 26 by meshing the threads 102 of the hanger running tool 100 with the threads 106 of the hanger 26 (e.g., rotating the body 101 of the hanger running tool 100 so that hanger running tool 100 screws into the hanger 26). Additionally, at block 354, the hanger running tool 100 and the hanger 26 may be disposed into the well 16 by moving the hanger running tool 100 and the hanger 26 in the second axial direction 199 along the well 16 (e.g., via the drive 37). When the hanger 26 reaches the shoulder 36 of the casing spool 22, further movement of the hanger running tool 100 and the hanger 26 in the second axial direction 199 may be blocked. Accordingly, an operator may understand that the hanger 26 is in position with respect to the casing spool 22 when the hanger running tool 100 and the hanger 26 no longer move in the second axial direction 199 and/or when a sensor indicates that the hanger running tool 100 encounters resistance above a threshold level.

At block 356, the hanger running tool 100 may be rotated in the second circumferential direction 120 (e.g., by the drive 37), thereby directing the first sleeve 124 and/or the second sleeve 170 to rotate in the first circumferential direction 119. As discussed above, because the threads 102 and 122 are oriented in opposite directions, the body 101 may move in the first axial direction 182 when the hanger running tool 100 rotates in the second circumferential direction 120 and the first sleeve 124 and/or the second sleeve 170 may be driven in the second axial direction 199 when the hanger running tool 100 rotates in the second circumferential direction. Movement of the second sleeve 170 in the second axial direction 199 may enable the second sleeve 170 to contact the push ring 156 and drive the push ring 156 in the second axial direction 199, which may in turn drive the lock ring 150 in the second axial direction 199. When the lock ring 150 contacts the preload ring 144, the lock ring 150 may be directed in the radial direction 114 toward the recess 240 of the casing spool 22 as a result of the inward tapered exterior surface 158 of the push ring 156.

Eventually, the lock ring 150 may engage with the surface 246 of the recess 240, which may block any further movement of the first sleeve 124, the second sleeve 170, and/or components of the hanger 26 in the second axial direction 199. Therefore, an operator may know when the lock ring 150 is in the recess 240 upon resistance to rotation of the hanger running tool 100 in the second circumferential direction 120 (or when a sensor indicates that the hanger running tool 100 experiences resistance above a threshold). Accordingly, at block 358, the hanger running tool 100 may be rotated in the second circumferential direction 194 (e.g., by the drive 37), opposite the first circumferential direction 120. As discussed above, rotation of the hanger running tool 100 in the first circumferential direction 119 may drive rotation of the first sleeve 124 and the second sleeve 170 in the first circumferential direction 119. The teeth 262 of the second sleeve 170 may engage with the teeth 264 of the push ring 156, thereby causing the push ring 156 to rotate in the first circumferential direction 119. Further, the push ring 156 may be engaged with the key 242, which may be disposed in the groove 244 of the preload ring 144. Therefore, rotation of the push ring 156 drives rotation of the preload ring 144 in the first circumferential direction 119. When the preload ring 144 rotates in the first circumferential direction 119, the preload ring 144 may partially unthread from the body 130 of the hanger 26, thereby directing the preload ring 144 in the first axial direction 182.

When the preload ring 144 moves in the first axial direction 182, the preload ring 144 may drive movement of the lock ring 150 in the first axial direction 182 to further secure the lock ring 150 in the recess 240 of the casing spool 22. When the lock ring 150 is in the preload position 260, rotation of the preload ring 144 may be substantially restricted, thereby also restricting rotation of the key 242 and the push ring 156 in the first circumferential direction 119. When rotation of the push ring 156 is restricted in the first circumferential direction 119 and the hanger running tool 100 continues to rotate in the first circumferential direction 119, the shear pin 184 between the first sleeve 124 and the second sleeve 170 may shear, as shown in block 360.

When the shear pin 184 shears, the body 101 and the first sleeve 124 may continue to rotate in the first circumferential direction 119 independent of the second sleeve 170. The hanger running tool 100 and/or an operator may sense shearing of the shear pin 184, and then rotate the hanger running tool again in the second circumferential direction 120, as shown in block 362. Therefore, as the hanger running tool 100 rotates in the second circumferential direction 120, the body 101 may ultimately become decoupled from the hanger 26 as the threads 102 of the hanger running tool 100 (e.g., positioned on the body 101) are unscrewed from the threads 106 of the hanger 26.

Accordingly, at block 364, the hanger running tool 100 may be removed from the well 16 when the threads 102 of the hanger running tool 100 are uncoupled from the threads 106 of the hanger 26 by directing the hanger running tool 100 in the first axial direction 182. Embodiments of the hanger running tool 100 disclosed herein may be configured to dispose the lock ring 150 of the hanger 26 in the locked position, preload the lock ring 150 of the hanger 26 in the casing spool 22, and remove the hanger running tool 100 from the hanger 26 in a single trip into the well 16.

While the disclosed subject matter may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A system, comprising:

a hanger running tool, comprising:

a tool body configured to couple to a hanger via a first set of threads;

a first sleeve configured to couple to the tool body via a second set of threads, wherein the first set of threads and the second set of threads are oriented in opposite directions, such that the tool body is driven in a first axial direction when the hanger running tool is rotated in a first circumferential direction and the first sleeve is driven in a second axial direction, opposite the first axial direction, when the hanger running tool rotates in the first circumferential direction; and a second sleeve coupled to the first sleeve, wherein the second sleeve is configured to engage a push ring of the hanger to drive a lock ring of the hanger into a recess of a tubular.

2. The system of claim 1, wherein the hanger running tool is configured to run and lock the hanger into the tubular in a single trip.

3. The system of claim 1, wherein the first set of threads comprise right hand threads and the second set of threads comprise left hand threads.

4. The system of claim 1, wherein the first set of threads are on an external surface of the tool body and an internal surface of the hanger, and wherein the second set of threads are on the external surface of the tool body and an additional internal surface of the first sleeve.

5. The system of claim 1, comprising the hanger, the hanger comprising:

a hanger body;

a preload ring disposed around an external surface of the hanger body, wherein the preload ring comprises a groove;

the lock ring configured to expand radially outward from the preload ring toward the recess of the tubular;

the push ring configured to drive the lock ring into the recess of the tubular; and a key coupled to the push ring, wherein the key is configured to slide in the groove of the preload ring in an axial direction.

6. The system of claim 5, wherein the second sleeve comprises first teeth and the push ring comprises second teeth, and wherein the first teeth and the second teeth are configured to engage with one another, such that rotation of the second sleeve drives rotation of the push ring.

7. The system of claim 5, wherein the second sleeve comprises an engaging member configured to engage a slot having an additional groove of the push ring, such that the hanger running tool is configured to retrieve the hanger from the tubular.

8. The system of claim 5, wherein the preload ring is coupled to the hanger body via a third set of threads, and wherein the third set of threads comprise the same orientation as the second set of threads.

9. The system of claim 1, wherein the hanger is configured to couple to the tubular of a mineral extraction system.

10. The system of claim 1, wherein the first sleeve is coupled to the second sleeve via a coupling pin and a shear pin, wherein the coupling pin is configured to drive the second sleeve in the second axial direction as the first sleeve moves in the second axial direction, and wherein the shear pin is configured to shear when the lock ring is in a preload position and the hanger running tool is rotated in a second circumferential direction.

11. The system of claim 10, wherein the shear pin is configured to shear to enable the hanger running tool to decouple from the hanger when the lock ring is in the preload position.

12. The system of claim 11, wherein the first sleeve is coupled to the tool body via an additional coupling pin, wherein the additional coupling pin is configured to drive the first sleeve in the first axial direction when a force is applied to the hanger running tool to remove the hanger running tool from a wellhead.

13. The system of claim 1, comprising a first seal between the tool body and the first sleeve and a second seal between the first sleeve and the hanger.

14. A method, comprising:

rotating a hanger running tool comprising a body, a first sleeve, and a second sleeve in a first circumferential direction to drive movement of the body in a first axial direction and to drive movement of the first sleeve in a second axial direction, opposite the first axial direction, wherein the body of the hanger running tool is coupled to the hanger via a first set of threads and the body of the hanger running tool is coupled to the first sleeve via a second set of threads;

engaging a lock ring of a hanger in a recess of a tubular as the first sleeve moves in the second axial direction;

rotating the hanger running tool in the second circumferential direction when the lock ring is engaged in the recess of the tubular to place the lock ring a preload position, wherein rotation of the body of the hanger running tool in the second circumferential direction directs the first sleeve in the first axial direction; and shearing a shear pin coupling the first sleeve and the second sleeve of the hanger running tool, thereby enabling the body and the first sleeve to rotate independent of the second sleeve when the lock ring is in the preload position.

15. The method of claim 14, comprising:

coupling the hanger running tool to the hanger; and disposing the hanger running tool and the hanger into a wellbore before rotating the hanger running tool in the first circumferential direction.

16. The method of claim 14, comprising rotating the hanger running tool in the first circumferential direction when the shear pin shears to decouple the hanger running tool from the hanger.

17. The method of claim 14, wherein the first set of threads comprise right hand threads and the second set of threads comprise left hand threads.

18. A system, comprising:

a hanger running tool, comprising:

a tool body configured to couple to a hanger via a first set of threads;

a first sleeve configured to couple to the tool body via a second set of threads, wherein the first set of threads and the second set of threads are oriented in opposite directions, such that the tool body is driven in a first axial direction when the hanger running tool is rotated in a first circumferential direction and the first sleeve is driven in a second axial direction, opposite the first axial direction, when the hanger running tool rotates in the first circumferential direction; and a second sleeve coupled to the first sleeve, wherein the second sleeve is configured to engage a push ring of the hanger to drive a lock ring of the hanger into a recess of a tubular; and a hanger, comprising:

a hanger body configured to couple to the hanger running tool via the first set of threads;

a preload ring disposed around an external surface of the hanger body, wherein the preload ring comprises a groove;

the lock ring configured to expand radially outward from the preload ring toward the recess of the tubular;

the push ring configured to drive the lock ring into the recess of the tubular when the second sleeve of the hanger running tool is driven in the second axial direction; and a key coupled to the push ring, wherein the key is configured to slide in the groove of the preload ring in the second axial direction.

19. The system of claim 18, wherein the hanger is configured to be run and locked into the tubular in a single trip.

20. The system of claim 18, wherein the preload ring is coupled to the external surface of the hanger body by a third set of threads, wherein the second set of threads and the third set of threads are oriented in the same direction.

* * * * *